United States Patent [19]

Ohnuma et al.

[11] 4,286,543

[45] Sep. 1, 1981

[54] APPARATUS FOR DEVELOPING ELECTROSTATIC IMAGE

[75] Inventors: Teruyuki Ohnuma, Yokohama; Seiichi Miyakawa, Nagareyama; Hajime Oyama, Tokyo, all of Japan

[73] Assignee: Ricoh Company, Ltd., Tokyo, Japan

[21] Appl. No.: 37,324

[22] Filed: May 8, 1979

[30] Foreign Application Priority Data

May 16, 1978 [JP] Japan ..... 53-58083

[51] Int. Cl.[3] ..... G03G 15/09

[52] U.S. Cl. ..... 118/657; 118/658

[58] Field of Search ..... 118/658, 647, 657

[56] References Cited

U.S. PATENT DOCUMENTS

| | | | |
|---|---|---|---|
| 3,263,234 | 7/1966 | Epstein et al. | 346/153 |
| 3,779,204 | 12/1973 | Altmann | 118/657 |
| 3,863,603 | 2/1975 | Buckley et al. | 118/658 |
| 4,034,709 | 7/1977 | Fraser et al. | 118/658 |
| 4,068,622 | 1/1978 | Vola | 118/658 |
| 4,100,884 | 7/1978 | Mochizuki et al. | 118/651 X |

*Primary Examiner*—Bernard D. Pianalto

*Attorney, Agent, or Firm*—Wyatt, Gerber, Shoup, Scobey & Badie

[57] ABSTRACT

A method of and apparatus for developing a latent electrostatic image in which a one-component type developer is deposited on the surface of a developer applicator having a conductive and elastic endless surface and the developer applicator is brought into pressure contact with a latent electrostatic image bearing member having a latent electrostatic image thereon. The peripheral speed of the developer applicator is slightly greater than that of the latent electrostatic image bearing member. In the case where the developer on the surface of the developer applicator is charged by charge injection from a blade electrode which is in contact with the developer, the present development apparatus is provided with a means for insulating the opposite top end portions of the blade electrode from the surface of said developer applicator.

13 Claims, 13 Drawing Figures

APPARATUS FOR DEVELOPING ELECTROSTATIC IMAGE

BACKGROUND OF THE INVENTION

The present invention relates to a method of and apparatus for effecting development by use of a one-component type developer in electrophotography and electrostatic recording.

The conventional developers for use in electrophotography and electrostatic recording can be roughly classified into a two-component type developer comprising toner and carriers and a one-component type developer consisting of only toner. The former developer can provide excellent copy images, while it needs a complicated detection apparatus for maintaining the toner concentration of the developer. Furthermore, in the two-component type developer, the carrier is not consumed and is used repeatedly, so that fatigue of the carrier takes place, which brings about toner deposition on the background of copies during a long use of the developer and the detection accuracy of a toner concentration detection apparatus is lowered while in use. On the other hand, the latter developer consists of only toner. Accordingly, it does not have the above-mentioned shortcomings and it is suitable for use in inexpensive copiers and the copiers using the one-component type developer rarely need maintenance.

However, the development method using the conventional one-component type developer is not always flawless, but has various shortcomings. For example, in a pressure application development method disclosed in Japanese Pat. No. Sho-52-36414, toner is deposited on a toner support member which is lined with a conductive and elastic foam material and the toner is charged to an opposite polarity to that of a latent electrostatic image by a plurality of triboelectric charging members during transporation of the toner and the toner support member is brought into pressure contact with a photoconductor and the toner support member and the photoconductor are moved in the manner that their relative peripheral speeds are substantially zero, whereby the latent electrostatic image is developed. In this method, a bias voltage is applied to the toner support member at the time of development in order to prevent toner from being deposited on the non-image area of the photoconductor. However, in the case where the original image is low in the contrast, development cannot be performed sufficiently. In other words, in the case where the original image is low in the contrast, consisting of light-colored letters and white background, application of a bias voltage for preventing deposition of toner on the background will cause the letter portion to disappear since there is little difference in the potential between the image area and the non-image area. Thus, the image area cannot be reproduced. Furthermore, in the case where the original image is low in the contrast, consisting of a dark background and darker letters, the non-image area is at a high potential. Accordingly, application of a high bias voltage for preventing deposition of toner on the non-image area will cause the leakage of the bias current from the toner support member to the photoconductor since the photoconductor and the toner support member are in pressure contact with each other. This will damage the photoconductor.

In Japanese laid-open patent applicaton No. Sho-50-117432, there is disclosed a method for charging toner on a development roller by a voltage applied electrode.

Furthermore, in a development apparatus described in Japanese laid-open patent application No. Sho-52-81228, a toner layer as thin as 20 to 60 μm is formed on a development roller and a doctor blade which serves an an electrode is brought into pressure contact with the development roller by spring means. The toner layer formed on the development roller is narrower than the development roller in the axial direction thereof and also narrower than the lengthwise width of the above-mentioned electrode. Accordingly, the opposite end portions of the electrode may contact with the opposite portions of the development roller so long as there is no toner therebetween, so that current is apt to leak from the electrode to the development roller. When current leaks from the electrode to the development roller, the potential difference between the two becomes small and the charging efficiency of toner is lowered. This could be prevented by making the width of the electrode equal to that of the toner layer. However, this is extremely difficult in practice. For instance, when the electrode is narrower than the toner layer, the toner which is not in contact with the electrode remains uncharged and accordingly, toner cannot be used sufficiently for development. On the other hand, when the electrode is wider than the toner layer, there is a danger that the above-mentioned current leakage may take place.

SUMMARY OF THE INVENTION

A feature of the present invention is in that, in a development method of and apparatus for developing a latent electrostatic image by depositing a one-component type developer on the surface of a developer applicator having a conductive and elastic endless surface and by bringing the developer applicator into pressure contact with a latent electrostatic image bearing member having the above-mentioned latent electrostatic image thereon, the developer applicator and the latent electrostatic image bearing member are moved in the same direction in their contact area and that the peripheral speed of the developer applicator is slightly greater than that of the latent electrostatic image bearing member.

Another feature of the present invention is that in a development apparatus in which a voltage applied blade electrode is brought into contact with a developer applicator having an endless, conductive and elastic surface which bears a one-component type developer consisting of only toner, and the toner is charged to a predetermined polarity by a potential difference between the blade electrode and the developer applicator and the toner is brought into contact with a latent electrostatic image formed on a latent electrostatic image bearing member, thus the latent electrostatic image is developed and the development apparatus is provided with a means for insulating the opposite end portions in the width direction of the blade electrode from the developer applicator.

According to the present invention, low-contrast images can be reproduced very well and a high quality image can be obtained without toner deposition on the background. Furthermore, since toner deposition on the background is reduced, the necessity for cleaning the latent electrostatic image bearing member is significantly reduced, and since some corona products produced on the latent electrostatic image bearing member at the time of corona charging are also removed, deterioration of the latent electrostatic image bearing member is prevented and the useful life thereof can be extended.

Furthermore, according to the present invention, since no leakage from the blade electrode to the developer applicator takes place when toner is charged by the blade electrode, insufficient charging of toner does not occur, so that a stable developed image without toner deposition on the background thereof can be obtained. Furthermore, a high contrast image can be obtained because of the high charging efficiency. According to the present invention, the toner layer is prevented from becoming thinner than a predetermined thickness, it never occurs that development cannot be effected due to the shortage of toner.

Accordingly, an object of the present invention is to provide an improved development method for developing latent electrostatic images, using a one-component developer.

Another object of the present invention is to provide an improved development method for developing latent electrostatic images which is excellent in reproducing low contrast color images and which is capable of obtaining a high quality developed image without toner deposition on the background thereof.

A further object of the present invention is to provide an improved development apparatus for developing latent electrostatic images, using a one-component type developer.

A still further object of the present invention is to provide an improved development apparatus capable of obtaining stable developed images with toner deposition on the background thereof by a sufficient charging of toner.

BRIEF DESCRIPTION OF THE DRAWINGS

For a better understanding of the present invention as well as the objects and other features thereof, reference will be had to the following detailed description which is to be read in conjunction with the drawings wherein.

DETAILED DESCRIPTION OF THE PREFERRED EMBODIMENTS

Figure 1:
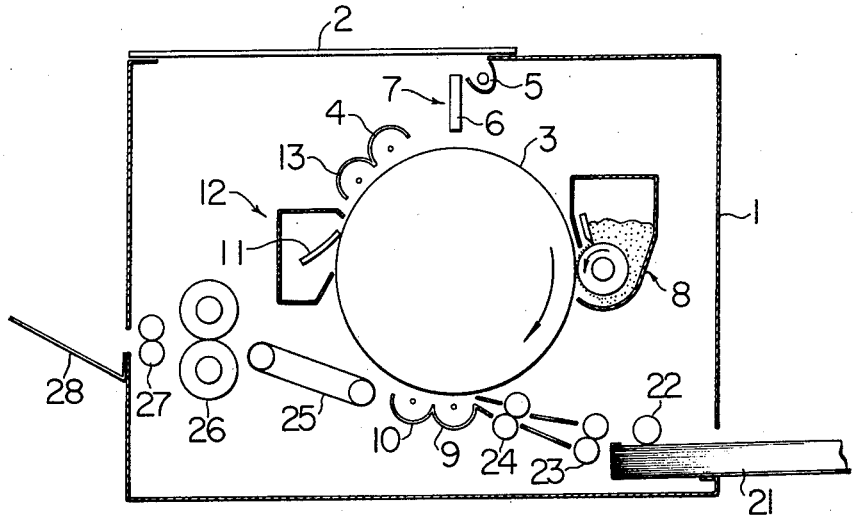
FIG. 1 is a diagrammatic drawing of an electrophotographic copying machine in which an embodiment of the present invention is employed.
Figure 2:
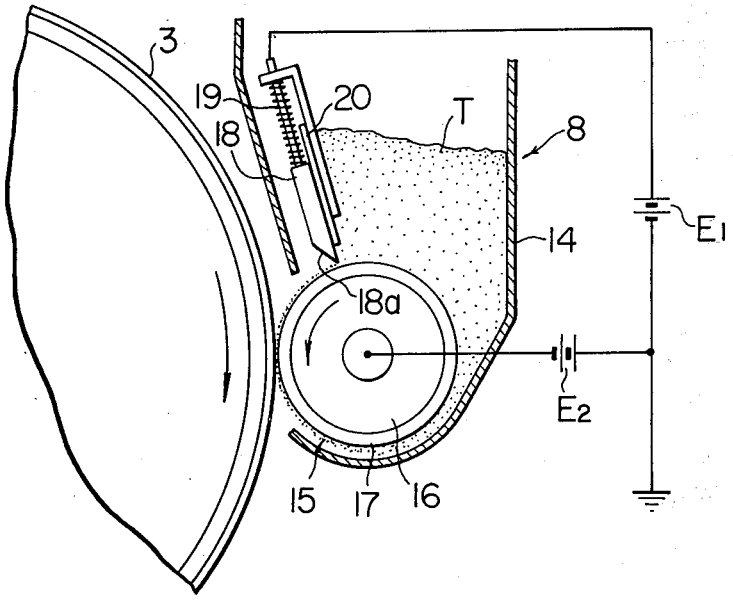
FIG. 2 is an enlarged sectional view of a development apparatus employed in the electrophotographic copying machine of FIG. 1.

Referring to FIG. 1, there is shown a diagrammatic drawing of an electrophotographic copying machine in which an embodiment according to the present invention is employed. Reference numberal 1 represents a housing of the electrophotographic copying machine. On an upper portion of the housing 1, there is mounted a contact glass 2 which is movable horizontally. Inside the housing 1, there is rotatably disposed a photoconductor drum 3. As the photoconductor for use in the photoconductor drum 3, selenium, zinc oxide, cadmium sulfide, and organic photoconductors can be used. As for the construction of the photoconductor, not only a two-layer type photoconductor comprising a photosensitive layer formed on a conductive support member but also a three-layer type photoconductor comprising further a transparent insulating layer on the photosensitive layer of the two-layer type photoconductor can be employed. In the case of the three-layer type photoconductor, a known copying process such as polarity reversing process has to be employed. Around the photoconductor drum 3, there are arranged, in the following order, a corona charging apparatus 4, a slit exposure optical system 7 comprising an illumination lamp 5 and a light transmitting phototransmitter (Selfoc: trade name) 6, a development apparatus 8, a corona image transfer apparatus 9, a charge quenching sheet separation apparatus 10, a cleaning apparatus 12 having a cleaning blade 11, and a charge quenching apparatus 13. The light transmitting phototransmitter 6 comprises at least two rows of a number of transmitter elements, which are arranged in the axial direction of the photoconductor drum 3. The light transmitting phototransmitter 6 serves to project mirror image on the surface of the photoconductor drum 3. Referring to FIG. 2, there is schematically shown a development apparatus 8 of the electrophotographic copying machine of FIG. 1. In the development apparatus 8, a development roller 15 is rotatably supported in a developer container 14. The development roller 15 comprises a conductive metallic core 16 and a conductive rubber layer 17 whose volume resistivity is not more than $10^8$ Ωcm, preferably not more than $10^5$ Ωcm and which is formed on the conductive metallic core 16. In an upper portion of the development roller 15, a doctor blade 18 is in pressure contact with the surface of the development roller 15 with a predetermined pressure by a spring means 19. The doctor blade 18 is a plate extending in the axial direction of the development roller 15 and has an acute top portion 18*a* and is made of a conductive material. The doctor blade 18 is supported by a support member 20 made of an insulating material which does not conduct electricity. In the developer container 14, there is placed a one-component type developer (hereinafter referred to as toner) T whose volume resisitivity is not less than $10^9$ Ωcm, preferably not less than $10^{14}$ Ωcm. The toner T comprises resins, such as styrene resin, phenol resin and epoxy resin, as a main component; and coloring agents, such as carbon black, Phthalocyanine Blue, Nigrosine, Aniline Blue, Chrome Yellow, Ultramarine Blue, Rose Bengale, azo dye, Victoria Blue and Fanal Blue; plasticizers, such as ester of fatty acid, for example, butyl stearate and butyl oleate, ester of phthalic acid, for example, dimethyl phthalate, dibutyl phthalate, or liquid paraffin, diethylene glycol dibenzoate and wax, and a small quanity of other additives. Another toner that can be used in the present invention is a toner that is used in the conventional two-component type developer. As the conductive rubber layer 17, various rubbers which are treated so as to be conductive can be employed. However, in view of deposition of toner on the conductive rubber layer 17, silicone rubber, polyurethane rubber, chloroprene rubber and nitrile rubber are preferable for use in the conductive rubber layer 17. Furthermore, in order to form a uniform toner layer on the photoconductor drum 3 and not to abrade the photoconductor drum 3, the suitable hardness of the conductive rubber layer 17 is in the range of 30 to 50 degrees in terms of JIS (Japanese Industrial Standards) Shore Hardness. When the surface of the photoconductor drum 3 is charged to a negative polarity, a potential in the range from 0 V to +500 V is appled to the doctor blade 18 by a power source $E_1$ in order to charge the toner positively, while to the development roller 15, there is applied a potential in the range from −200 V to −300 V by a power source $E_2$. This bias voltage applied to the development roller 15 is the same in polarity as that of the potential of a non-image area of the photoconductor drum 3 and is the same or slightly higher than the potential of the non-image area. The development roller 15 is rotated counterclockwise at peripheral speed $V_D$, while the photoconductor drum 3 is rotated clockwise at a peripheral speed $V_P$. The development roller 15 and the photoconductor drum 3 are respectively rotated in the same direction in their contact area, and are relatively moved in the relationship that $V_D$:$V_P$ is in the range from 1:1.1 to 1:1.5 The development process of this electrophotographic copying machine will be described later.

Referring back to FIG. 1, transfer sheets are held in a sheet feed cassette 21 which is detachably disposed in the coying machine. Sheet feed cassettes with various sizes can be provided for selective use thereof by attaching a desired size cassette to the copying machine. The transfer sheet is transported from the sheet feed cassette 21 by a sheet feed roller 22. Between the paper feed cassette 21 and the image transfer apparatus 9, there are disposed sheet transportation rollers 23 and register rollers 24. In a transfer sheet path ahead of the charge quenching sheet separation apparatus 10, there are disposed a transfer belt apparatus 25, an image fixing apparatus 26, sheet discharge rollers 27 and a sheet discharge tray 28 in this order. The transfer belt apparatus 25 comprises an air suction mechanism (not shown) for sucking the transfer sheet to a transfer belt and transporting the transfer sheet. The image fixing apparatus 26 comprises a pair of heat rollers. As the image fixing apparatus 26, the conventionally known image fixing apparatus, such as a pressure application image fixing apparatus and a heat atmosphere image fixing apparatus, can also be used.

Figure 3:
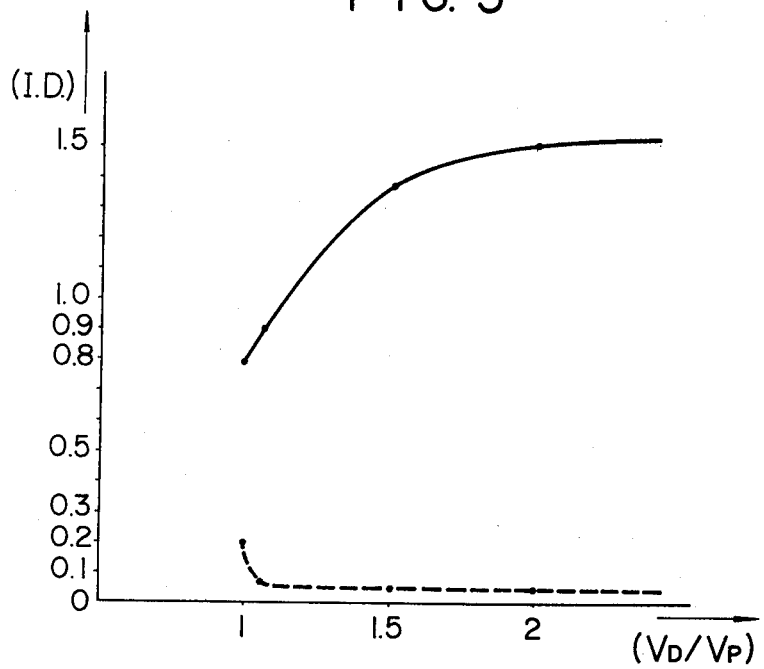
FIG. 3 shows the relationship between the peripheral speed ratio $V_D/V_P$ of a development roller to a photoconductor drum and the reflected image density (I.D.)

The operation of this copying machine will now be explained. When the power supply is turned on the image fixing apparatus 26 is energized so that the surface of the heat rollers is preheated up to a temperature at which image fixing can be performed. In the meantime, the photoconductor drum 3 is rotated at least one revolution and the charges on the surface of the photoconductor drum 3 are quenched by the charge quenching apparatus 13 and, at the same time, the surface of the photoconductor drum 3 is cleaned by the cleaning apparatus 12. When the heat rollers of the image fixing apparatus 26 are heated up to a predetermined temperature, an indication is made on an outside portion of the copying machine that copying is possible. When a print button is depressed, the photoconductor drum 3 begins to be rotated again and, at the same time, operation of each copying process unit disposed around the photoconductor drum 3 is initiated. The photoconductor drum 3 is uniformly charged by the corona charging apparatus 4. An original document placed on the contact glass 2 which is moved horizontally and is then illuminated by the illumination lamp 5 so that the light image of the original document is projected on the surface of the photoconductor drum 3 through the light transmitting phototransmitter 6, whereby a latent electrostatic image corresponding to the original image is formed on the photoconductor drum 3. The latent electrostatic image is developed with the toner when the latent electrostatic image is caused to pass through the development apparatus 8. Referring to FIG. 2, the toner in the developer container 14 is deposited on the surface of the conductive rubber layer 17 of the development roller 15 and transported by the development roller 15. The thickness of the toner layer on the development roller 15 is controlled to be of a predetermined thickness by the doctor blade 18. The toner is charged positively when it passes under the doctor blade 18. The charging of the toner is determined in accordance with the potential difference between the doctor blade 18 and the development roller 15, but in principle, the toner is charged by charge injection from the doctor blade 18, namely by the so-called charge injection method. Accordingly, a blade for effecting this charge injection can be made of a member different from a blade for controlling the quantity of the toner on the development roller 15. The thus-charged toner is brought into contact with the photoconductor drum 3. In the image area on the photoconductor drum 3, the electrostatic attraction of a latent electrostatic image for the toner is greater than the physical attraction of the development roller 15 for the toner while in the non-image area on the photoconductor drum 3, the electrostatic attraction of the photoconductor drum 3 for the toner is apparently nearly zero by a bias voltage applied to the development roller 15, so that the toner is held on the development roller 15 by the physical attraction of the development roller 15 for the toner. As mentioned previously, the development roller 15 is rotated slightly faster than the photoconductor drum 3. The effect of such a faster rotation of the development roller 15 was confirmed by the following experiment. Referring to FIG. 3, there is shown the relationship between the reflected image density (I.D.) and the ratio $V_D/V_P$ of the peripheral speed of the photoconductor drum 3 to that of the development roller 15. The solid line in FIG. 3 represents the characteristic in the image area while the dash line represents the characteristic in the non-image area. As can be seen from FIG. 3, when the peripheral speed ratio $V_D/V_P$ is nearly 1, the image density in the image area is not only insufficient but also the quantity of toner deposited in the non-image area is so great that toner deposition on the background is considerable. As the peripheral speed ratio $V_D/V_P$ is increased by increasing the number of rotations of the development roller 15, the image density in the image area tends to increase and, at the same time, deposition of toner in the non-image area tends to be reduced, so that a high contrast image can be obtained. However, when the development roller 15 is rotated too quickly relative to the rotation speed of the photoconductor drum 3, the mechanical friction between the development roller 15 and the drum 3 becomes great and the developed image is disordered in the forward direction and the abrasion of the drum 3 increases. From this point of view, the acceptable peripheral speed ratio is about 1:1.5 at best.

Figure 4:
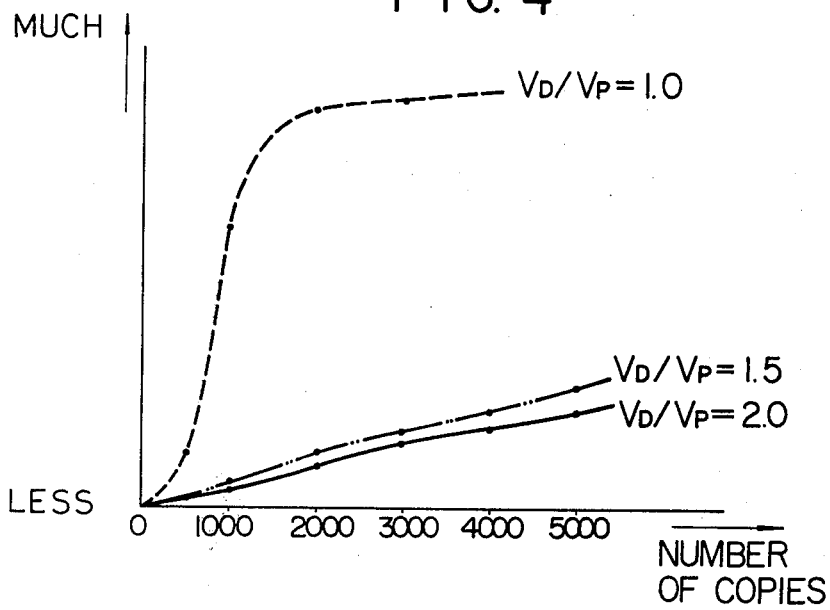
FIG. 4 shows the relationship between the number of copies and occurence of blurred images caused by a corona-charging product which are plotted for various choices of the parameter of the speed ratio $V_D/V_P$.

Referring to FIG. 4, there are shown the experiment results of the relationship between the number of copies (abscissa) and the blurr of image (ordinate) caused by corona products for various choices of the parameter $V_D/V_P$, such as $V_D/V_P=1$, $V_D/V_P=1.5$ and $V_D/V_P=2$. In FIG. 4, the dash line indicates $V_D/V_P=1.0$ and a long and two short dash line indicates $V_D/V_P=1.5$ and a solid line indicates $V_D/V_P=2$. Now the corona products will be explained in detail. When corona charging is repeatedly made to the photoconductor, ozone and nitrogen oxide which are formed by corona charging or ammonium nitrite which is formed by the combination of ozone and nitrogen oxide with ammonium in the air accumulate on the surface of the photoconductor. These compounds are called corona products. When the corona products accumulate, the electrostatic characteristic of the photoconductor is deteriorated so that normal latent electrostatic images cannot be formed and the developed image becomes blurred. As can be seen from FIG. 4, when $V_D/V_P=1$, the image becomes blurred all over when the number of copies reaches as small as 2,000. In contrast with this, in both cases of $V_D/V_P=1.5$ and $V_D/V_P=2.0$, only part of the image is blurred after 5,000 copies. This indicates that the corona products adhered to the surface of the photoconductor is cleaned up by the development roller 15 since the development roller 15 is in pressure contact with the photoconductor drum 3 and the development roller 15 is rotated faster than the photoconductor drum 3. Furthermore, in the case of $V_DV_P=1.5$, almost no abrasion of the surface of the photoconductor drum 3 was observed after 5,000 copies since the development roller 15 is elastic, so that the useful life of the photoconductor drum 3 was extended.

The thus-developed toner image is brought into contact with a transfer sheet which is fed from the sheet feed cassette 21 and is transported by the register roller 24 in synchronism with the photoconductor drum 3. The toner image on the photoconductor drum 3 is electrostatically transferred to the transfer sheet by the corona image transfer apparatus 9 which performs corona charging in the polarity opposite to that of toner. Charges applied to the back side of the transfer sheet by the corona image transfer apparatus 9 are quenched by the charge quenching sheet separation apparatus 10 which is disposed adjacent the corona image transfer apparatus 9. An apparatus capable of performing a.c. corona charging and an apparatus capable of performing d.c. corona charging having a polarity opposite to that of the image transfer corona can be used as the charge quenching sheet separation apparatus 10. The electrostatic attraction between the transfer sheet and the photoconductor drum 3 is reduced by the charge quenching sheet separation apparatus 10 and the transfer sheet is separated from the photoconductor drum 3 by the elasticity and weight of the transfer sheet itself. In such a sheet separation method, the transfer sheet can be separated without disordering the toner image near the end portion of the surface of the photoconductor drum 3, to that an excellent image reproduction can be attained. The thus-separated transfer sheet is transported to the image fixing apparatus 26 by the transfer belt apparatus 25. The toner image is permanently fixed to the transfer sheet by the image fixing apparatus 26 and is then discharged onto the sheet discharge tray 28. In the meantime, on the surface of the photoconductor drum 3, there remains untransferred image after the process of image transfer. The untransferred image is removed by the cleaning apparatus 12. According to the present invention, since amount of toner deposited in the non-image area is reduced, the specifications for the cleaning apparatus 12 are simplified. The cleaning apparatus 12 has the cleaning blade 11 by which the toner powder removed from the surface of the photoconductor drum 3 is recovered and returned to the development apparatus in order to reuse the recovered toner. When toner is used under condition such that reuse of the toner is difficult, the toner powder is discarded. After the cleaning of the photoconductor drum 3, the residual potential of the surface of the photoconductor drum 3 is removed by the charge quenching apparatus 13. Thus, one copy cycle is completed. In the continuous copying operation, the above-mentioned copy process is repeated.

As the development roller 15, a belt-shaped apparatus can also be used in the present invention. In the case where toner is charged, charging by charge injection and charging by trioelectric charging can be used at the same time by constructing the doctor blade 18 with a material different from the toner in the triboelectric series, whereby the charging efficiency can be raised. This method is suitable for a high speed development. Charging only by triboelectric charging using a blade is also possible.

Figure 5:
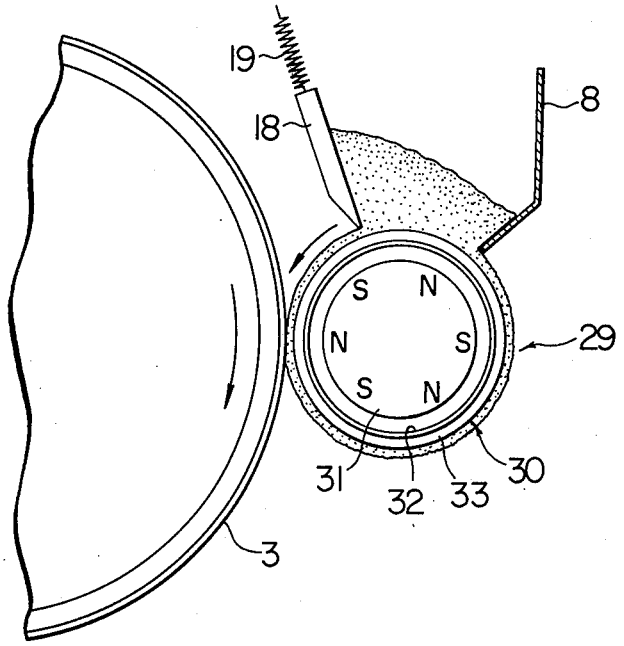
FIG. 5 is a schematic sectional view of another embodiment of a development apparatus according to the present invention.

Referring to FIG. 5, there is shown a schematic sectional view of another embodiment of a development apparatus according to the present invention. In FIG. 5, the photoconductor drum 3 is rotated clockwise at the peripheral speed $V_P$. The development roller 29 comprises a non-magnetic sleeve 30 and a permanent magnet 31 disposed inside the non-magnetic sleeve 30. The non-magnetic sleeve 30 comprises a conductive support member 32 made of non-magnetic aluminum and a conductive elastic layer 33 formed on the conductive support member 32. The conductive elastic layer 33 is made of the same material as that of the conductive rubber layer 17 which is employed in the first embodiment. A development bias voltage is applied to the non-magnetic sleeve 30. The permanent magnet 31 is a magnetic roller having alternate N magnetic poles and S magnetic poles. For various purposes, such alternate arrangement of N magnetic poles and S magnetic poles is not always necessary. Instead of the magnetic roller, a plurality of magnets can be used. A development roller 29 is in pressure contact with the photoconductor drum 3 with a predetermined pressure by a mechanism (not shown). The non-magnetic sleeve 30 is rotated counterclockwise at the peripheral speed $V_D$. The relationship between the peripheral speed $V_P$ of the photoconductor drum 3 and the peripheral speed $V_D$ of the development roller 29 is the same as in the case of the first embodiment. Above the development roller 29, there is situated a toner hopper 8. On the outlet side of the toner hopper 8, there is disposed a doctor blade 18. The doctor blade 18 is made of the same conductive material as that of the doctor blade 18 in the first embodiment and a voltage for charging toner is likewise applied to the doctor blade 18, whereby the toner which passes under the doctor blade 18 is charged by the charge injection method. In the toner hopper 8, there is placed a magnetic toner. The magnetic toner is transported from the toner hopper 8 by the magnetic attraction of the magnet 31 for the toner and the surface characteristics of the conductive elastic layer 33. At this moment, excessive magnetic toner is removed by the doctor blade 18 so that a predetermined amount of the magnetic toner is transported, passing under the doctor blade 18. When the toner has passed under the doctor blade 18, a magnetic brush is formed on the surface of the non-magnetic sleeve 30 so that the toner is moved in the movement direction of the non-magnetic sleeve 30. However, unlike the ordinary magnetic brush development, in the contact portion between the photoconductor drum 3 and the non-magnetic sleeve 30, since a pressure is applied to the toner, development is performed under application of a considerable pressure to the toner. In the development section, the development roller 29 (in this case, the non-magnetic sleeve 30) moves relative to the photoconductor drum 3 as mentioned previously. Therefore, deposition of toner on the image area and on the non-image area of the photoconductor drum 3 is not simply determined by the electrostatic attraction and the magnetic attraction for the toner. In the case of the present embodiment, magnetic attraction is used. However, since the conductive elastic layer originally has the characteristic of attracting the toner, much magnetic force is not required in the present embodiment. However, in comparison with non-magnetic toner, the average particle size of the magnetic toner is slightly greater. Therefore, the attraction of the conductive elastic layer for the magnetic toner is slightly less than that for the non-magnetic toner.

Figure 6:
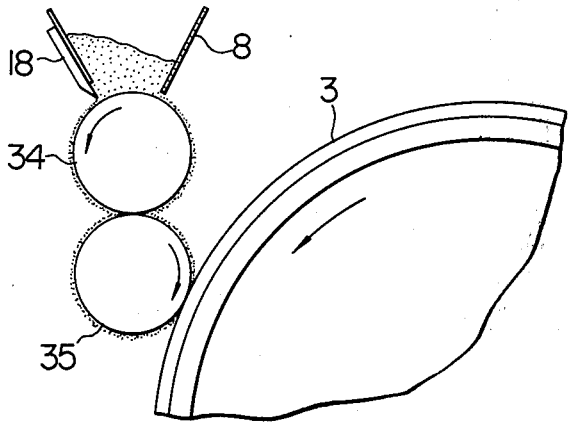
FIG. 6 is a schematic sectional view of a further embodiment of a development apparatus according to the present invention.

In the above-mentioned embodiment, the toner is directly supplied from the toner hopper 8 to the development roller 29. It may be possible to dispose a roller for transporting the toner between the toner hopper 8 and the development roller 29. Referring to FIG. 6, there is shown a development apparatus having such a toner transporation roller 34. In FIG. 6, the toner transporation roller 34 is rotated in pressure contact with or in close proximity to a development roller 35 for supplying toner to the photoconductor drum 3. Above the toner transportation roller 34, there are disposed the toner hopper 8 and the doctor blade electrode 18. The construction of the toner transportation roller 34 is the same as that of the development roller 35, and the development roller 35 and the toner hopper 8 and the blade electrode 18 are designed in the same construction as those in the above-mentioned first and second embodiments. Therefore, detailed explanation about those members is omitted here. The toner, transported from the toner hopper 8 and then charged by the blade electrode 18, is transferred to the development roller 35 which is rotated in contact with or in close proximity to the toner transportation roller 34. The toner is then brought into contact with the photoconductor drum 3. As is the case of the above-mentioned embodiments, a development bias voltage is applied to the development roller 35 in order to prevent toner from being deposited on the background.

In the development apparatus according to the present invention, the number of the development rollers is not limited to one, but a plurality of development rollers can be used. The same thing applies to the doctor blade. A plurality of doctor blades disposed side by side can be employed. Furthermore, the development apparatus according to the present invention can be used as the development section as well as the cleaning section in a copying machine capable of making one copy with the two revolutions of the photoconductor drum.

Figure 7:
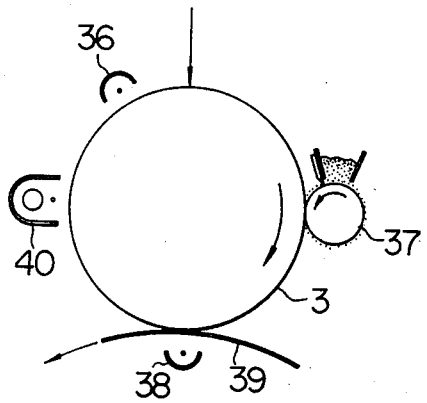
FIG. 7 is a diagrammatic drawing of another electrophotographic copying machine in which an embodiment of a development apparatus according to the present invention is employed.

Referring to FIG. 7, there is shown a diagrammatic drawing of an electrophotographic copying machine of the above-mentioned type having a development apparatus according to the present invention. In the electrophotographic copying machine, during the first revolution of the photoconductor drum 3, the photoconductor drum 3 is uniformly charged by a corona charger 36 and a latent electrostatic image is formed on the surface of the drum 3 by projection of a light image thereon and the latent electrostatic image is then developed by a development apparatus 37. With a further revolution of the drum 3, the developed toner image is transferred to a transfer sheet 39 by an image transfer apparatus 38 and the charges on the surface of the drum 3 are quenched by a charge quenching apparatus 40 which performs corona charging and illumination simultaneously. Thus, the first revolution of the photoconductor drum 3 is completed. During the second revolution of the photoconductor drum 3, the corona charger 36 and the exposure apparatus and the image transfer apparatus 38 are inoperative and the toner remaining on the photoconductor drum 3 is removed by the development apparatus 37. At this time, by increasing the bias voltage applied to the development roller, removal and recovery of the toner can be performed more effectively. Generally, the metallic material used in the doctor blade electrode for charge injection has a greater coefficient of friction than that of the conventional blade. For instance, with respect to steel, the coefficient of friction of teflon is 0.04 and that of Derlin 0.10 and that of aluminum 0.36 and that of brass 0.46 and that of annealed copper 0.04. Therefore, although a resin blade has no problem, a metallic blade has some problems in that the necessary amount of toner cannot be obtained on the development roller since the fluidity of the toner is hindered due to the greater coeffient of friction and that it is not suitable for charge injection by the blade, even if the metallic blade is formed in the same shape as that of the resin blade.

Figure 8:
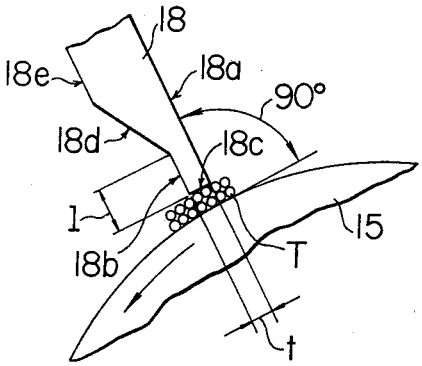
FIG. 8 is a diagrammatic drawing of a top portion of a doctor blade employed in the present invention.

These shortcomings can be removed by designing the shape of the blade electrode as shown in FIG. 8. Namely, referring to the cross section of a top portion of the blade electrode, the blade electrode has a flat side surface 18*a* on the upstream side of the development roller 15, a flat side surface 18*b* on the downstream of the development roller 15, the flat side surface 18*b* having a predetermined length l and being parallel to the side surface 18*a*, and a top end flat surface 18*c* facing the surface of the development roller 15, the top end flat surface 18*c* being normal to the side surface 18*a* and the side surface 18*b*. Continuing from the side surface 18*b*, an inclined surface 18*d* is formed, which is connected to a side surface 18*e* on the rear end of the blade.

It is appropriate that the width t of the top end flat surface 18*c*, namely the thickness of the top portion of the blade is in the range from 0.05 mm to 1.5 mm and that a back end portion of the blade is thicker than the top portion of the blade. When the width t of the top end flat surface 18*c* is smaller than 0.05 mm, the toner layer T cannot be charged sufficiently, which results in producing a developed image with toner deposition on the background thereof. On the other hand, when the width t is greater than 1.5 mm, the toner layer T becomes too thick, which results in producing a developed image with too much toner deposition. In this case, when the pressure of the blade 18 against the surface of the development roller 15 is increased in order to make the toner layer thinner, the abrasion of the top portion of the blade 18 is speeded up. The width t of the top end flat surface 18*c* is determined in accordance with the kind of toner, the material of the blade, the pressure of the blade 18 against the surface of the development roller 15, the peripheral speed of the development roller 15, and the potential difference between the blade 18 and the development roller 15. The length l of the parallel portion can be set as desired, with its maximum length 2 mm. The thus-formed blade 18 is disposed in such a manner that the flat side surface 18*a* is almost included in a plane parallel to the axial direction of the development roller 15 and normal to a tangent plane of the surface of the development roller 15. The top portion of the blade 18 is positioned in close proximity with the surface of the development roller 15 or brought into pressure contact with the surface of the development roller 15 as the case may be.

Figure 9:
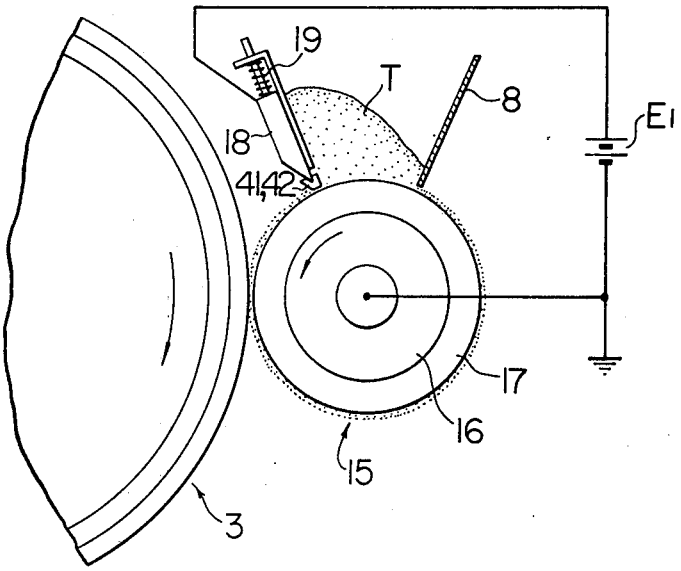
FIG. 9 is a schematic sectional view of a further embodiment of a development apparatus according to the present invention.
Figure 10:
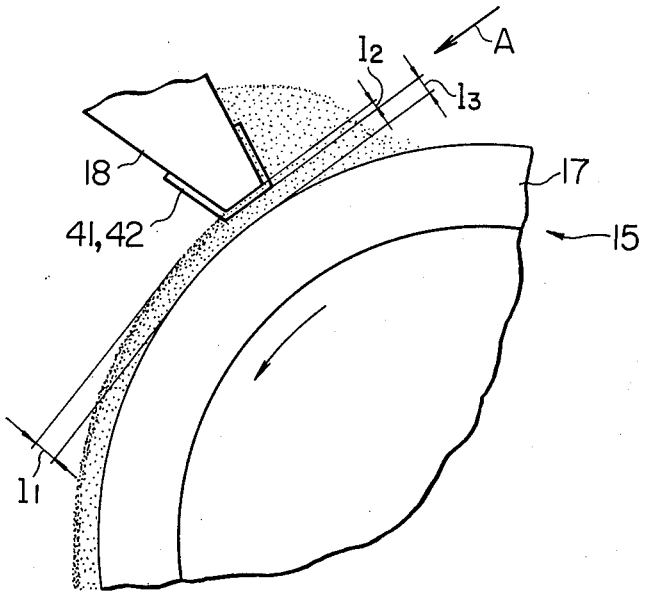
FIG. 10 is a schematic enlarged sectional view of a top portion of an electrode of the development apparatus of FIG. 9.

In the thus-constructed blade apparatus, since the top end surface 18*c* of the blade 18 which contacts with the toner layer T on the surface of the development roller 15 is flat, it can contact with the toner layer T sufficiently and accordingly it can give charges to the toner sufficiently. Furthermore, since the top portion of the blade 18 has the same cross section area in the portion of the predetermined length l, even if the top portion is abraded to some extent, the contact condition with the toner layer is not changed. Accordingly, the charging condition and the development condition do not change. Furthermore, since the blade 18 is disposed so that the side surface 18*a* on the upstream side of the rotation of the development roller 15 is positioned along the axial direction of the development roller 15 and almost normal to the surface of the development roller 15, the excessive toner scraped by the top portion of the blade 18 is not compressed by the blade 18 so that a toner layer T with a required thickness can be formed on the development roller 15. Furthermore, the contact condition of the blade 18 with the surface of the development roller 15 can be maintained in a stable manner. In order to charge the toner efficiently and sufficiently and to obtain a stable and high quality image without toner deposition on the background thereof, the blade electrode can be provided with the following means. Referring to FIG. 9, there is shown a blade electrode 18 with such means 41 and 42. In FIG. 9, the same members as those in FIG. 2 are given the same reference numerals, respectively. Reference numerals 41 and 42 in FIGS. 10 and 11 indicate insulating coatings. The insulating coatings 41 and 42 are designed to be as thin as $l_2$, which is thinner than the toner layer, namely the space $l_1$ between the surface of the elastic layer 17 of the development roller 15 and the top end of the blade electrode 18. In the opposite end portions of the blade electrode 18, the distance $l_3$ between the insulating coatings 41 and the elastic layer 17 is $l_1-l_2$. Since the space $l_1$ between the blade electrode 18 and the elastic layer 17 changes delicately in various conditions, the thickness $l_2$ of the insulating coatings 41 and 42 has to be selected so that the blade electrode 18 does not contact with the elastic layer 17 (namely $l_3$ does not become zero) when the space $l_1$ becomes minimum ($l_1$ min). However, when one-component type developer is used, since the toner layer is as thin as 20 to 60 μm, it is difficult to set strictly the thickness in the above-mentioned range. Therefore, so long as the insulating coatings 41 and 42 are disposed on the opposite sides of the blade electrode 18, even if $l_1$ changes and the blade electrode 18 comes close to the elastic layer 17 and the insulating coatings 41 and 42 are in contact with the elastic layer 17, there is no disadvantage. In other words, a voltage for changing toner is applied to the blade electrode 18 and the insulating coatings 41 and 42 prevent current from flowing from the end portion of the blade electrode 18 to the development roller 15, so that insufficient charging, which may occur without the insulating coatings 41 and 42, is prevented, thus a high contrast image can be obtained. Furthermore, since the insulating coatings 41 and 42 are set in the above-mentioned thickness, the toner layer can be pressed by the blade electrode 18. And should the insulating coatings 41 and 42 be in contact with the elastic layer 17, the thickness of the toner layer on the development roller 15 can be maintained at $l_2$ so that the state that development is not performed by the lack of developer can be prevented.

Referring to FIG. 9, to the blade electrode 18, there is applied to a voltage of a polarity opposite to that of a latent electrostatic image from a power source $E_1$. A core metal 16 of the development roller 15 is grounded. As a matter of course, as mentioned previously, in order to prevent toner from being deposited on the background portion on the photoconductor, a development bias voltage whose polarity is the same as that of the potential of the background and which is equal to or slightly higher than the potential of the background can be applied to the development roller 15 at the time of development.

Figure 11:
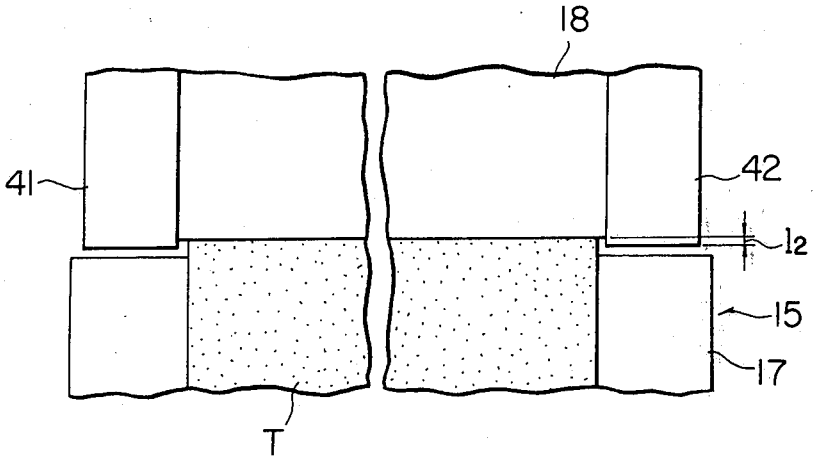
FIG. 11 is a diagrammatic drawing of the top portion of the electrode viewed from the direction of the arrow A in FIG. 10.

Referring to FIG. 11, a toner layer exists on the elastic layer 17 of the development roller 15, except the opposite end portions thereof. The effective portion of the blade electrode 18 covers at least the toner layer and on the opposite end portions of the blade electrode 18, the insulating coatings 41 and 42 are formed outside of the toner layer so that they do not contact with the toner layer. The insulating coatings 41 and 42 can be formed by coating the opposite end portions of the electrode blade 18 with an insulating material, such as Teflon (trade name) or by adhering such an insulating film to the opposite end portions of the electrode blade 18.

In the above-mentioned embodiment, the insulating coating is formed on the blade electrode 18. Another method is to attach independent insulating members to the opposite end portions of the blade electrode 18. In this case, the length $l_2$ of the insulating members projected from the top portion of the blade electrode 18 has to be set in the above-mentioned range.

Referring now back to FIG. 9, the development roller 15 is forcibly rotated by an outer drive apparatus (not shown). Another method is to bring the development roller 15 into pressure contact with the photoconductor drum 3 so that the development roller 15 is driven by the photoconductor drum 3. Alternatively, the development roller 15 is rotated counterclockwise at a peripheral speed equal to or slightly higher than that of the photoconductor drum 3, so that toner is discharged from the hopper 8 onto the surface of the elastic layer 17 and is transported. The thickness of the toner layer on the development roller 15 is controlled to a predetermined thickness by the blade electrode 18 and, at the same time, the toner which passes under the blade electrode 18 is charged to a polarity opposite to that of a latent electrostatic image. The thuscharged toner is brought into contact with the photoconductor drum 3 so that the latent electrostatic image is developed.

Figure 12:
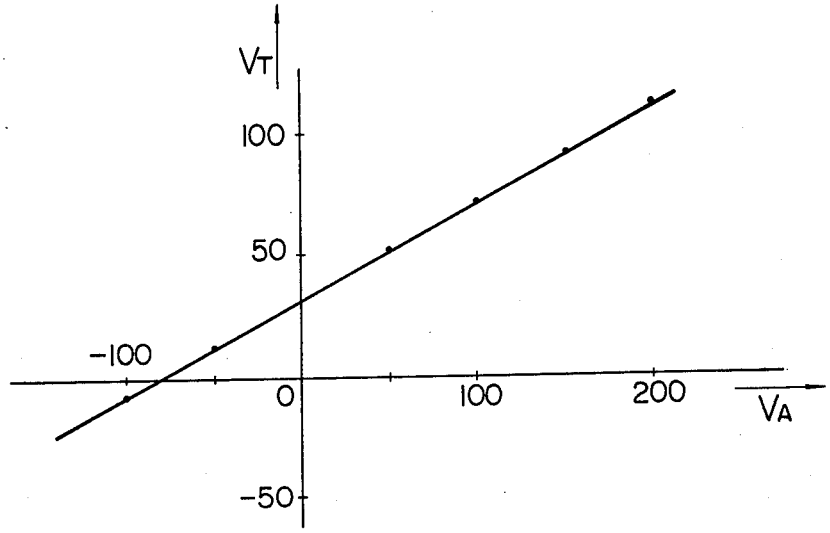
FIG. 12 shows the relationship between the charging potential $V_T$ of toner and the potential difference $V_A$ between the blade electrode and the development roller in the present invention.

The inventors of the present invention obtained the relationship between the voltage applied to the electrode and the charging of the toner in the following experiment: In the development apparatus as shown in FIG. 9, a toner with a volume resistivity of $10^{16}$ Ωcm was employed and by the blade electrode 18, a toner layer with an approximately 40 μm thickness was formed on the development roller 15. As the elastic layer 17, a conductive silicone rubber with a rubber hardness of 45 degrees and resistivity not more than $10^5$ Ωcm was employed. The development roller 15 was rotated at a 200 mm/sec peripheral speed. When the maximum current which flows from the blade electrode 18 to the development roller 15 through the toner layer was set at 0.4 mA and a normal value of the current was set at about 0.05 mA, toner fusing did not take place at the development roller 15 and the blade electrode 18. The voltage difference $V_A$ between the voltage applied to the blade electrode 18 and the voltage applied to the development roller 15 is proportional to the toner charging potential $V_T$ as shown in FIG. 12. Therefore, by changing the voltage applied to the blade electrode 18, the charging potential of toner, namely the charge density can be changed so that an appropriate development can be attained in accordance with the kind of original. For instance, in the case of a low contrast original, a voltage applied to the blade electrode 18 is increased in order to increase the charging of the toner and, at the same time, a development bias voltage applied to the development roller 15 is slightly increased in order to prevent toner desposition on the background of the copy.

Figure 13:
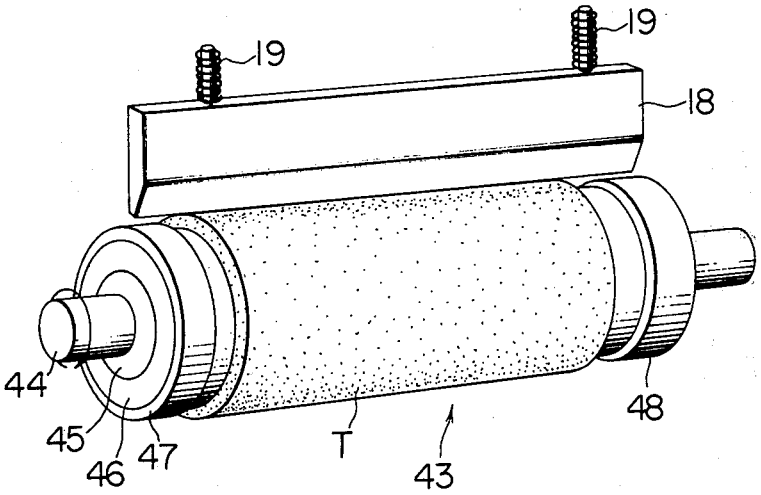
FIG. 13 is a schematic perspective view of a main portion of a further embodiment of a development apparatus according to the present invention.

Referring to FIG. 13, there is shown a perspective view of such a means. In FIG. 13, a development roller 43 comprises a conductive core metal 45 having a shaft 44, a conductive elastic layer 46 formed on the core metal 45, and insulating coatings 47 and 48 formed in the opposite end portions of the development roller 43. The conductive elastic layer 46 is made of the same material as that in the aforementioned embodiment. The insulating coatings 47 and 48 are formed by spray coating of an insulating material, such as silicone rubber. Alternatively, the elastic layer is made so as to be insulating and a central portion of the elastic layer is treated so as to be conductive. On the development roller 46, there is formed a toner layer T as shown in FIG. 13. The insulating coatings 47 and 48 are formed so as to be thinner than the toner layer T. In an upper portion of the development roller 43, the blade electrode 18 is brought into pressure contact with the development roller 43 by a spring means 19 and the top end of the blade electrode 18 is in uniform contact with the toner layer T. The shape of the top portion of the blade electrode 18 is the same as that of the electrode in the aforementioned embodiment. A voltage for charging toner is applied to the blade electrode 18 and the toner on the development roller 43 is charged to a polarity opposite to that of a latent electrostatic image by the potential difference between the blade electrode 18 and the development roller 43.

Normally, the blade electrode 18 is in contact with the toner layer T only. However, when the toner layer T becomes thinner and the space between the blade electrode 18 and the development roller 43 becomes narrower, the opposite end portions of the blade electrode 18 contacts with the insulating coatings 47 and 48 formed on the elastic layer 46. Therefore, current does not flow from the opposite end portions of the blade electrode 18 to the development roller 43. Furthermore, since toner layer as thick as the insulating coatings 47 and 48 is formed on the development roller 43, so long as the development roller 43 is designed so as to permit the toner layer to contact with the photoconductor drum, the development can be effected normally. In FIG. 13, there is not shown a toner hopper, but a toner hopper similar to that shown in FIG. 9 is employed here.

In the above-mentioned embodiment, the insulating members are formed on the opposite end portions of either the blade electrode or the development roller. However, such insulating members can be formed on the opposite end portions of both the blade elecrode and the development roller. Furthermore, as in the embodiment of FIG. 5, a magnet can be incorporated in the development roller and as the one-component type developer, a magnetic toner can be employed.

Furthermore, in the present invention, as a latent electrostatic image bearing member, a dielectric material can be used as well, besides the photoconductor, and a method for forming a latent electrostatic image on the dielectric material is not limited in particular.

What is claimed is:

1. A development apparatus for developing a electrostatic image comprising:

a developer applicator member having a conductive and elastic endless surface which bears a one-component type developer thereon, means for moving said developer applicator member at a slightly higher peripheral speed that that of a latent electrostatic image bearing member which bears a latent electrostatic image to be developed, a developer container for supplying said developer to said developer applicator member, and a blade electrode for charging said developer to a predetermined polarity, which is disposed in pressure contact with said developer on the surface of said developer applicator member.

2. A development apparatus for developing a latent electrostatic image as claimed in claim 1, wherein the ratio of the peripheral speed of said developer applicator member to that of said latent electrostatic image bearing member is from 1:1.1 to 1:1.5.

3. A development apparatus for developing a latent electrostatic image as claimed in claim 1, wherein a bias voltage is applied to said developer applicator member.

4. A development apparatus for developing a latent electrostatic image as claimed in claim 1, wherein said one-component type developer is a magnetic toner and a magnet is disposed inside said developer applicator member.

5. A development apparatus of claim 1 wherein insulating means are provided for insulating the lateral end portions of said blade electrode from said developer applicator member.

6. A development apparatus for developing a latent electrostatic image as claimed in claim 5, wherein said insulating means is an insulator held to the lateral end portions of said blade electrode.

7. A development apparatus for developing a latent electrostatic image as claimed in claim 6, wherein a space between of said blade electrode and said developer applicator member, which is formed by the presence of said insulator, is smaller than the thickness of a toner layer formed on said developer applicator member.

8. A development apparatus for developing a latent electrostatic image as claimed in claim 5, wherein said insulating means is an insulator held to those portions of said developer applicator member lying adjacent the lateral end portions of said blade electrode member.

9. A development apparatus for developing a latent electrostatic image as claimed in claim 8, wherein a space between said blade electrode and said developer applicator member, which is formed by the presence of said insulator, is smaller than the thickness of a toner layer formed on said developer applicator member.

10. A development apparatus for developing a latent electrostatic image as claimed in claim 5, wherein a bias voltage is applied to said developer applicator member.

11. A development apparatus for developing a latent electrostatic image as claimed in claim 5, wherein said one-component type developer is a magnetic toner and a magnet is disposed inside said developer applicator member.

12. A development apparatus for developing a latent electrostatic image as claimed in claim 5, wherein the peripheral speed of said developer applicator member is slightly greater than that of said latent electrostatic image bearing member.

13. A development apparatus for developing a latent electrostatic image as claimed in claim 12, wherein the ratio of the peripheral speed of said developer applicator member to that of said latent electrostatic image bearing member is in the range from 1:1.1 to 1:1.5.

* * * * *